United States Patent [19]

Detweiler

[11] Patent Number: 5,076,622

[45] Date of Patent: Dec. 31, 1991

[54] FUEL FILLER LATCH ASSEMBLY

[75] Inventor: Charles A. Detweiler, Durand, Mich.

[73] Assignee: Lectron Products, Inc., Rochester Hills, Mich.

[21] Appl. No.: 558,073

[22] Filed: Jul. 25, 1990

[51] Int. Cl.[5] ..... E05C 1/10

[52] U.S. Cl. ..... 292/201; 292/125; 292/DIG. 60

[58] Field of Search ..... 292/201, 125, 122, 225, 292/110, DIG. 53, DIG. 55, DIG. 60, DIG. 62

[56] References Cited

U.S. PATENT DOCUMENTS

| | | | |
|---|---|---|---|
| 2,709,910 | 6/1955 | Vigmostad | 292/219 X |
| 2,840,405 | 6/1958 | Feltz et al. | 292/122 |
| 2,898,138 | 8/1959 | Van Noord | 292/201 X |
| 3,915,491 | 10/1975 | Montgomery | 292/201 X |
| 4,030,322 | 6/1977 | Pettit | 292/201 X |
| 4,419,641 | 12/1983 | Slavin et al. | 292/201 X |
| 4,917,418 | 4/1990 | Gokee | 292/125 |

*Primary Examiner*—Richard E. Moore

*Attorney, Agent, or Firm*—Harness, Dickey & Pierce

[57] ABSTRACT

A solenoid actuated self-compensating latching apparatus adapted for use in motor vehicle applications. The latching appartus includes a solenoid assembly having an armature movable between a first and second position. A latch mechanism is secured to the solenoid assembly and includes a latch member coupled to the armature for lockingly engaging a striker when the armature is in one position and releasably disengaging the striker when the armature is in the other position. The latch mechanism is self-compensating to align the latch member relative to the striker, prior to engagement therewith, to compensate for alignment variation between the latch member and the striker.

46 Claims, 4 Drawing Sheets

FUEL FILLER LATCH ASSEMBLY

BACKGROUND AND SUMMARY OF THE INVENTION

The present invention relates to automotive latching devices and, in particular, to a solenoid actuated self-compensating latch mechanism particularly adapted for use with a fuel filler door latch system to prevent unauthorized access to the fuel tank.

In an effort to inhibit unauthorized access to a vehicle's fuel tank, automobile manufacturers are evaluating various fuel filler door latch systems. Conventionally, fuel filler door latch systems have included the use of a striker fixed to the filler door and a latch member ("hook") mounted to the vehicle body. The latch member engages the striker to lock the fuel filler door in a "latched" position. To release the fuel filler door, the latch member is moved to an "unlatched" position to disengage the striker. The fuel filler door is spring loaded to open partially when the latch member moves to the "unlatched" position for allowing the operator to pivot the door to a full open position.

One method of locking the fuel filler door includes the use of a key lock mechanism. However, as a convenience option, vehicle manufacturers are installing remotely actuated fuel filler door latch release systems. Such remotely actuated systems permit an occupant within the passenger compartment of the vehicle to release the fuel filler door prior to exiting the vehicle. Typically, remotely actuated latching systems include the use of linear actuation cables or linkages for manually releasing the filler door. In general, a vehicle occupant pulls a release handle within the passenger compartment to move the latch member out of engagement with the striker. As an alternative, many vehicles are now being equipped with electrically actuated release systems. Electrically actuated systems include a solenoid device mounted remote from the fuel filler area and a linkage coupled between a movable solenoid armature and the latch member. Energization of the solenoid moves the armature and, consequently, the latch member to disengage the striker.

Because the fuel filler door is a cosmetic "fit and finish" component of an automobile, it must be precisely aligned during assembly. It is common for conventional fuel filler latching mechanisms to require adjustment of the alignment between the latch member and the striker following vehicle assembly to assure the release system will function properly.

A disadvantage associated with "prior art" solenoid operated fuel filler latching mechanisms is the excessive armature travel required to assure adequate system reliability. Conventional solenoid actuated release systems must generate a large armature travel to account for the dimensional variations associated with the components making up a fuel filler door assembly and the latch mechanism. As is known in solenoid design, it is an inherent characteristic that the magnetic attractive force produced by a solenoid device decreases as its armature travel increases. Therefore, to assure release of the striker it has been necessary to provide an extremely large and expensive solenoid to generate a sufficient force output with a sufficiently large travel. Consequently, solenoid actuated fuel filler door latch systems have, until recently, been extremely expensive due to large solenoid requirements to account for dimensional and alignment variations.

Accordingly, it is a primary object of the present invention to overcome the disadvantages of the prior art and provide an improved latching apparatus having means for compensating for dimensional variations to permit application of smaller, lighter and less expensive solenoids. In particular, the present invention includes a solenoid actuated self-compensating latch mechanism for minimizing the effects of dimensional variations which previously had to be accounted for by the solenoid. Because dimensional variations and tolerance "stack-ups" associated with production assembly operations can be compensated for without impacting solenoid travel requirements, the travel requirement of the solenoid is substantially reduced.

In general, this is accomplished by providing a self-compensating latch mechanism which is coupled to the movable armature of a solenoid. The solenoid and latch mechanism can be assembled to define a compact, unitary, solenoid/latch assembly. Likewise, the solenoid/-latch assembly can be mounted to a fuel filler housing to define a fuel filler housing assembly which can be readily installed as a subassembly into the vehicle. The self-compensating latch mechanism permits the magnetic attractive force requirements for a solenoid to be predicated on a substantially reduced amount of armature travel for releasing the latch from the striker. Therefore, the overall size and electrical power requirements of the solenoid can be reduced.

The latch mechanism of the present invention includes a support frame adapted to be mounted to a motor vehicle structure. The support frame supports an elongated carrier member which is pivotally mounted thereto to provide the self-compensating latching function. A latch arm is pivotally carried on the carrier member, independent of the support frame, and is coupled to the movable armature of the solenoid. When a lid or door member is closed, the striker initially contacts the carrier member to pivotally align the latch arm relative to the striker prior to engagement therewith. The pivotal movement of the carrier upon contact with the striker compensates for the dimensional variability inherent in assembly of door latch assemblies. Thereafter, the striker contacts the latch arm to pivot the latch arm until the striker is latched thereto.

To release the striker, the solenoid device is actuated to cause the latch arm to disengage the striker. Consequently, the present invention provides increased reliability, is relatively simple and inexpensive to manufacture, and is convenient for subassembly into a vehicle.

Additional objects and advantages of the present invention will become apparent from a reading of the following detailed description of the preferred embodiments which makes reference to the accompanying drawings.

DETAILED DESCRIPTION OF THE PREFERRED EMBODIMENTS

Figure 1:
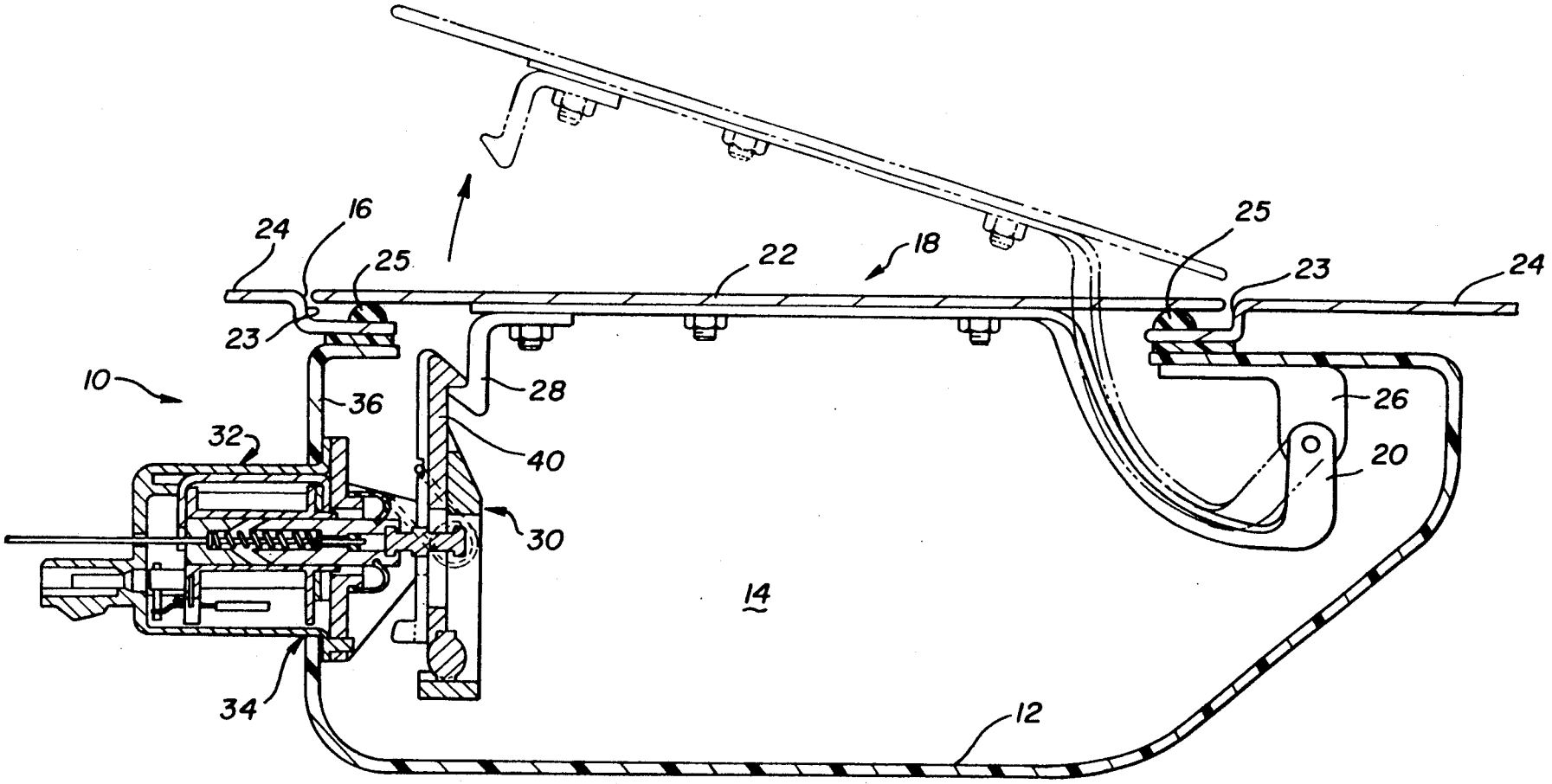
FIG. 1 is a section view of a solenoid-operated self-compensating latch mechanism installed in a fuel filler housing assembly according to the present invention.

Referring to FIG. 1 of the drawings, a sectional view of a fuel filler housing assembly 10 according to the present invention is shown. Fuel filler housing assembly 10 includes a housing 12 defining a chamber 14 therein and an opening 16 to provide access to a fuel filler cap (not shown). Housing 12 is fabricated of a material resistant to the effects of gasoline and, preferably, is a blow molded high density polyethylene (HDPE) material. A door assembly 18 having a pivotable hinge member 20 on which a door 22 is secured is provided to enclose opening 16. Preferably, housing assembly 10 is mounted within a recessed portion of a vehicle such that door 22 has a high quality "fit and finish" within an offset surface 23 of exterior body panel 24 following assembly. Door 22 is adapted to engage one or more resilient bumper members 25 affixed within offset surface 23 upon being moved to the closed position. Attached to hinge 20, opposite its pivot joint 26, is a striker 28 which is provided for lockingly engaging a self-compensating latching mechanism 30 to lock door 22 in a closed position. It will be appreciated that hinge 20 is normally biased to open at least partially upon disengaging striker 28 from latching mechanism 30. The function and structure of latch mechanism 30 will be hereinafter described in greater detail.

In general, self-compensating latch mechanism 30 is operatively coupled to a solenoid assembly 32 to define a solenoid/latch assembly 34. Solenoid/latch assembly 34 is adapted to be mounted to a generally planar inner wall portion 36 of housing 12 such that latch mechanism 30 and a portion of solenoid 32 are disposed within chamber 14. FIG. 1 illustrates the relative pivotal movement of striker 28 when door assembly 18 is moved from an open "unlatched" position (shown in phantom lines) to a closed "latched" position. In this manner, latch mechanism 30 is positioned within chamber 14 to lockingly engage striker 28 when door 22 is moved to a closed position.

Figure 2:
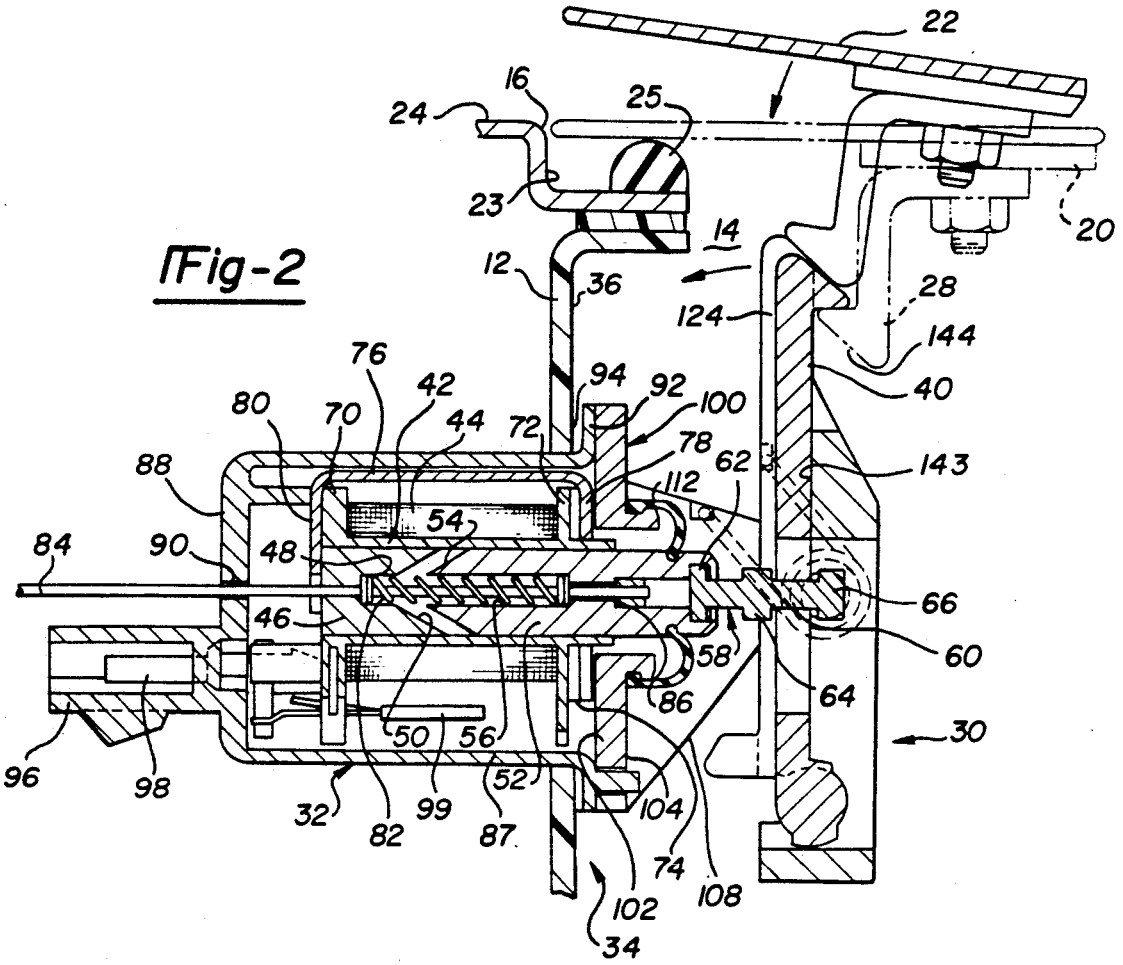
FIG. 2 is an enlarged view of FIG. 1 illustrating the self-compensating latch mechanism in operative relationship to a solenoid assembly.
Figure 3:
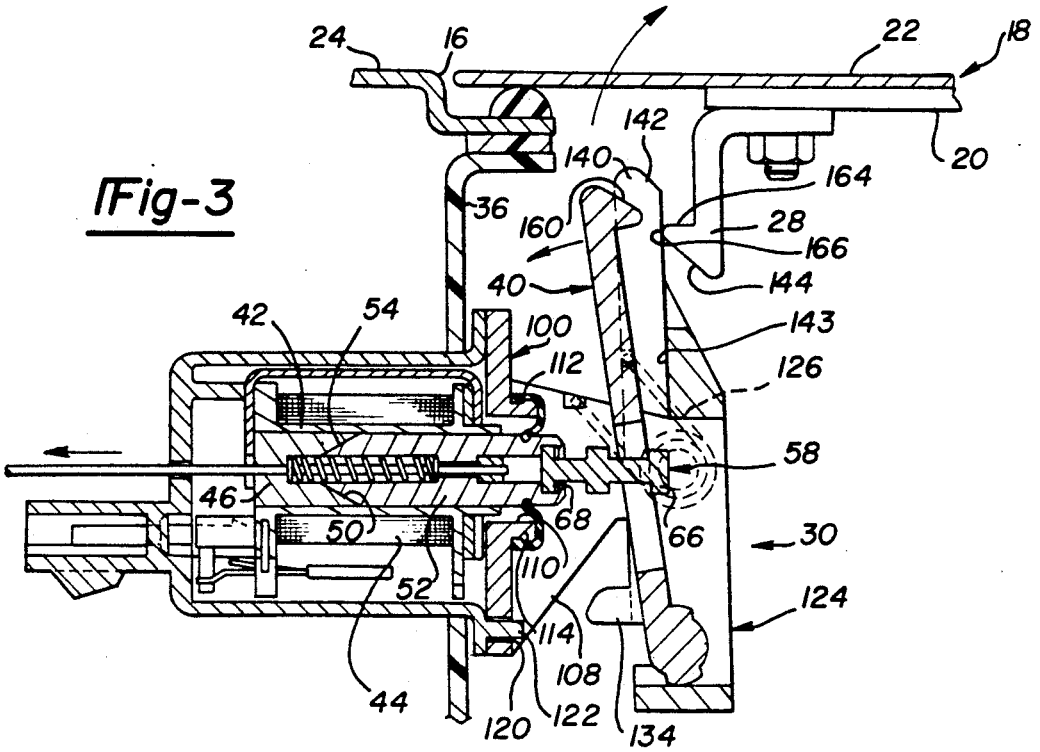
FIG. 3 is an enlarged view, similar to FIG. 2, illustrating the self-compensating latch mechanism in an "unlatched" position.

With particular reference to FIGS. 2 and 3, the components making up solenoid 32 are illustrated in greater detail. In accordance with a principal feature of this invention, solenoid 32 is provided to pivotally move latch arm 40 for releasably disengaging latch arm 40 from striker 28. Solenoid 32 is structurally designed to protect the working components therein and includes a bobbin 42 having a plurality of coil windings 44 wound thereon. Bobbin 42 is fabricated from a non-magnetic material and, preferably, is made of a nylon-type material. A pole piece 46 extends through the hollow center core of bobbin 42. Pole piece 46, in turn, has a central axial bore 48 formed therein which forms a concave frusto-conical surface 50 at one of its ends.

Armature 52, which in the preferred embodiment is made of steel, is movable in an axial direction through a limited range of travel within central bore 48 of bobbin 42. Armature 52 has a convex frusto-conical surface 54 which corresponds in shape to that of pole piece surface 50. Additionally, an axial passage 56 is formed through armature 52 such that bore 48 and passage 56 are axially aligned. An armature extension 58 is coupled to armature 52 at its axial end opposite frusto-conical surface 54. Armature extension 58 has a reduced diameter central stem 60 which defines first end landing 62, central landing 64 and second end landing 66. First end landing 62 is secured within an enlarged cavity 68 provided in passage 56 such that armature extension 58 is movable upon axial translational movement of armature 52. Likewise, latch arm 40 is coupled to armature extension 58. In particular, latch arm 40 is disposed on stem 60 between central landing 64 and second end landing 66.

Coil bobbin 42 encircles pole piece 46 and armature 52 and forms a pair of axially separated radial flanges 70 and 72. An annular-shaped magnetic flux collector ring 74 surrounds armature 52 and is contiguous with flange 72. A generally U-shaped magnetic strap member 76 having an annular-shaped segment 78 at one end and a radial flange 80 at its opposite end surrounds pole piece 46, bobbin 42, coil windings 44, armature 52 and flux collector ring 74. Alternatively, flux collector 74 and U-strap 78 may be fabricated as a unitary assembly.

A helical spring 82 is disposed within an enlarged central portion of axially aligned bore 48 and passage 56 so as to bias armature 52 away from pole piece 46. Likewise, an actuation cable 84 passing through bore 48, spring 82 and into passage 56 which is secured against a shoulder 86 is provided for manually moving armature 52 against the biasing force of spring 82 to disengage latch arm 40 from striker 28. Actuation cable 84 has a release lever (not shown) which is pulled by the vehicle occupant in situations when solenoid 32 is inoperable (i.e. dead battery).

In general, when solenoid 32 is energized by current flow through coil windings 44, the magnetic flux path of solenoid 32 is defined by pole piece 46, armature 52, flux collector ring 74 and U-shaped strap member 76. The primary air gap of solenoid 32 is defined by the tapered frusto-conical surfaces 50 and 54 for generating an attractive magnetic force therebetween.

A non-magnetic housing 87 is provided in which the solenoid components herebefore described ar enclosed. Housing 87 is generally cylindrical in shape having an outer closed end portion 88 which has a bore 90 through which actuation cable 84 extends. The opposite end of housing 87 is open and includes an outwardly extending radial shoulder 92. Shoulder 92 is positioned generally adjacent inner wall surface 36 upon installation of solenoid/latch assembly 34 into fuel filler housing 12. More particularly, a gasket 94 provides a seal between inner wall surface 36 and shoulder 92. An electrical connector 96 is formed at closed end portion 88 of housing 87 which is adapted to be connected to a switch located in the passenger compartment. More specifically, coil windings 44 are connected to the switch via terminals 98. A PTC (positive temperature coefficient) thermistor 99, or any other known thermal switch, is provided for thermal protection to windings 44.

With particular reference to FIG. 2, the orientation and cooperation of the components of solenoid 32 when coil windings 44 are "de-energized" is illustrated. When solenoid 32 is "de-energized", latch arm 40 is maintained in "latched" engagement with striker 28 (phantom lines) thereby locking door 22 in a closed position. In this condition, the magnetic attractive force between pole piece 46 and armature 52 is less than the biasing force of helical spring 82 acting on armature 52. As such, armature 52 is maintained in an axially displaced position away from pole piece 46. Once armature 52 is fully extended away from pole piece 46, central land 64 engages a rear surface of latch arm 40 to assist in maintaining "latched" engagement with striker 28.

Referring now to FIG. 3 the orientation and cooperation of solenoid 32 when coil windings 44 are "energized" is illustrated. As shown, armature 52 is magnetically attracted toward pole piece 46 by the induced magnetic field produced by windings 44. While the preferred air gap configuration is illustrated as defined by frusto-conical surfaces 50 and 54, it is contemplated that other working air gap configurations, such as planar air gap surfaces, could be utilized. In this "unlatched" position, the energized solenoid 32 acts to pivot latch arm 40 out of engagement with striker 28. More particularly, upon energization of solenoid 32, armature 52 and armature extension 58 move axially in a direction toward pole piece 46 such that third landing 66 acts on a front surface of latch arm 40 to pivot it out of engagement with striker 28. Energization of solenoid 32 is provided by a switch located inside the vehicle. Actuation of the switch by the vehicle occupant produces an attractive force between pole piece 46 and armature 52 in opposition to the biasing force of helical spring 82.

Figure 4:
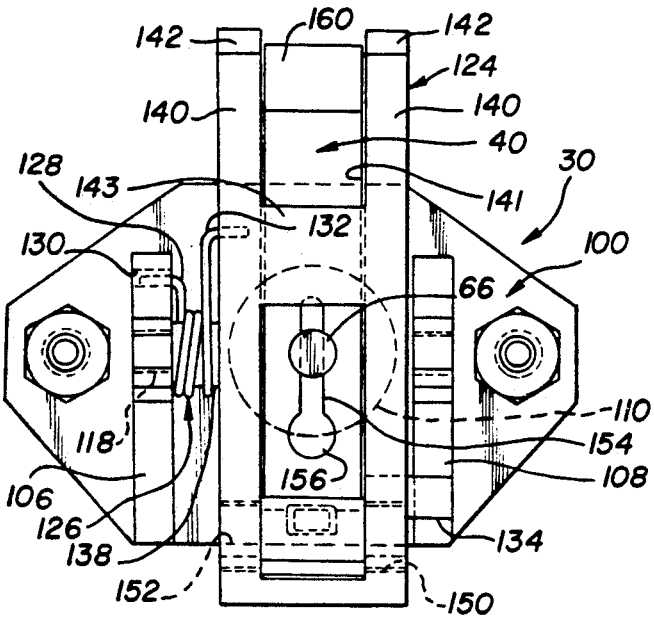
FIG. 4 is a plan view of the self-compensating latch mechanism.
Figure 5:
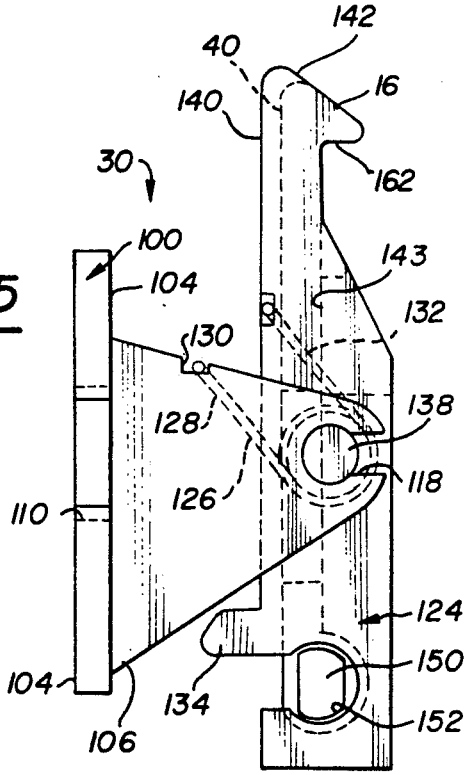
FIG. 5 is a side view of FIG. 4.
Figure 6:
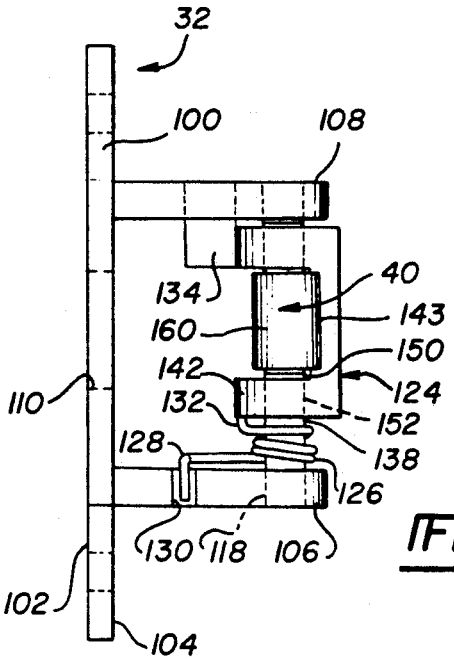
FIG. 6 is a top view of FIG. 4.

In accordance with another primary principle of the present invention, latch mechanism 30 will now be described in greater detail. It is to be understood that the following description is merely intended to be exemplary in nature and that modifications can be made within the fair meaning and scope of the present invention. With particular reference to FIGS. 4 through 6, a preferred structure of latch mechanisms 30 is shown. The components of latch mechanism 30 are preferably fabricated from an impact resistant, high strength, thermoplastic material. In particular, latch mechanism 30 includes a base support frame 100 which is adapted to be mounted to inner side wall 36 within chamber 14. Support frame 100 includes a substantially planar back wall surface 102 which is mounted flush with shoulder 92 of solenoid housing 87. Transversely extending from a planar front wall surface 104 of support frame 100 are side walls 106 and 108 which are generally triangular in configuration. Side walls 106 and 108 are preferably aligned in parallel relation to each other. Support frame 100 has a central opening 110 located between side walls 106 and 108 through which a portion of armature 52 and armature extension 58 extend for permitting extension 58 to be interconnected to latch arm 40. An elastomeric diaphragm 112 is interconnected between an outstanding flange portion 114 of support frame 100 and armature 52 so as to seal the internal components of solenoid 32 during translational movement of armature 52. Side walls 106 and 108 each have an aperture 118 extending therethrough which is generally parallel to planar front surface 104. Support frame 100 has a tab slot 120 through which a positioning tab 122 projecting from shoulder 92 of solenoid housing 87 extends for orienting the components during subassembly of solenoid/latch assembly 34.

Pivotally secured between side walls 106 and 108 in generally transverse orientation thereto is an elongated carrier member 124. Carrier 124 has an integral pivot pin 138 projecting from opposite lateral edges thereof which are disposed within apertures 118 provided in side walls 106 and 108. In this manner, carrier 124 is pivotally coupled to support frame 100 to define a first pivot. A torsion spring 126 is located between side wall 106 and carrier 124 and is wound around pin member 138. Spring 126 is adapted to bias a top portion of carrier 124 in a direction away from support frame 100. Spring 126 has a first end 128 mounted in slot 130 on side wall 106 and a second end 132 on a portion of carrier 124. Ends 128 and 132 of spring 126 are generally attached to their respective latch components above the horizontal center line of carrier 124 to assist in biasing the top end of carrier 124 away from solenoid 32. Stop block 134 is provided on a lower rear portion of carrier 124 to contact a tapered surface 136 on one of the side walls 106 and 108. In this manner, the predetermined range of pivotal movement of carrier 124 in a direction away from solenoid 32 is defined.

Elongated carrier 124 is preferably configured as a generally inverted A-shaped member having two upstanding parallel legs 140 at its uppermost portion which define an open space 141 therebetween. The top edge of upstanding legs 140 define a camming surface 142 which is configured to be engageable with a camming surface 144 provided on striker 28 when door 22 is moved to its closed position as is seen in FIG. 2. In this manner, the force exerted on camming surface 142 overcomes the opposing biasing force of torsional spring 126 such that the top end of carrier member 124 is pivoted toward solenoid 32. Carrier 124 is pivoted until camming surface 144 of striker 28 engages latch arm 40. In this manner, pivotal movement of carrier 124 acts to align latch arm 40 relative to striker 28 to compensate for alignment variations in striker 28.

Figure 7:
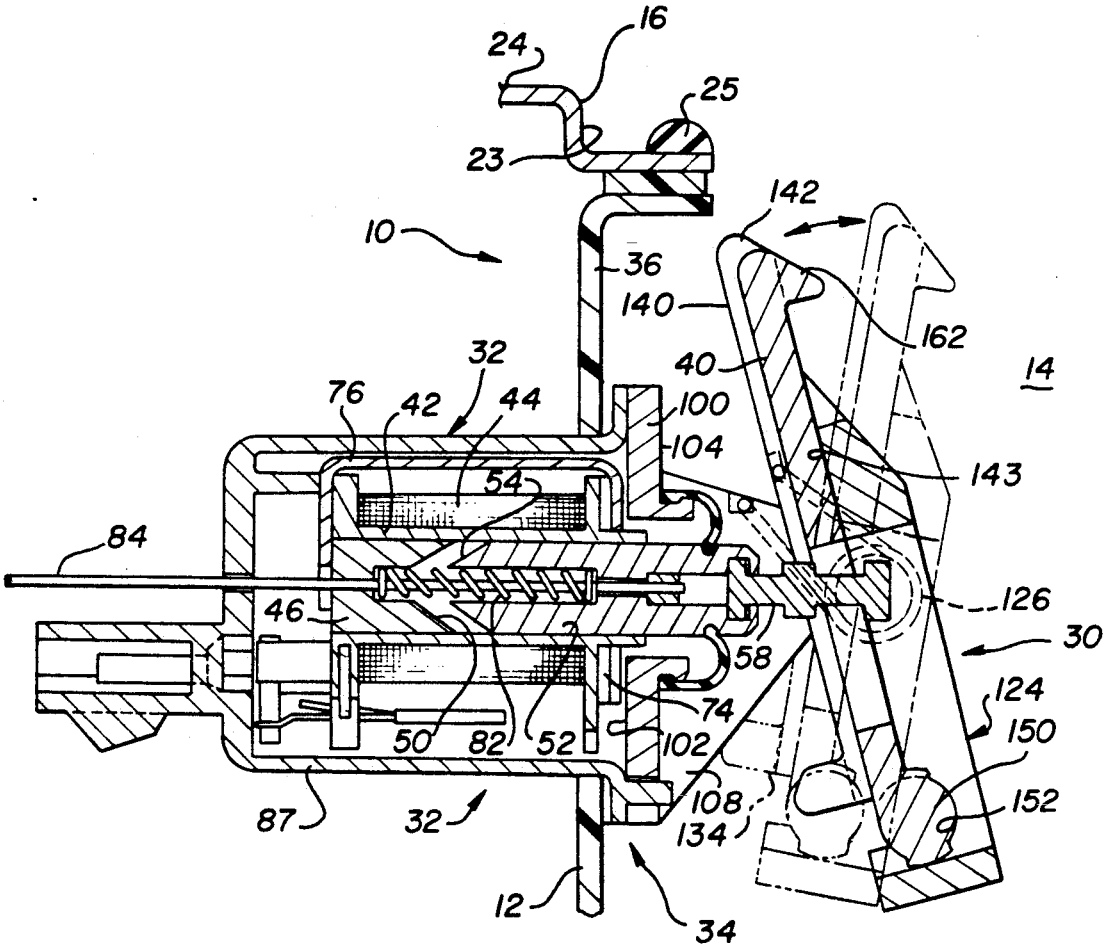
FIG. 7 is a sectional view showing the range of self-compensation associated with the latch mechanism of the present invention.

FIG. 7 illustrates the pivotal range of movement of carrier 124 upon contact with striker 28. In particular, this pivotal range of movement of carrier 124 provides the self-compensating characteristic for latch mechanism 30 which minimizes dimensional variations commonly associated with the location of a striker relative to a latch member. Therefore, the range of pivotal movement of latch arm 40 required to assure engagement with striker 28 when door 22 is closed and, disengagement from the striker 28 to release door 22 is significantly reduced.

Latch arm 40 is disposed in open space 141 between upstanding legs 140 of carrier 124 and includes a generally oblong pivot pin 150 extending from opposite lateral edges along a generally lower portion thereof. Pivot pin 150 is disposed in a similarly sized aperture 152 extending through a lower portion of carrier 124. In this manner, latch arm 40 is secured to carrier 124 for pivotal movement relative thereto to define a second pivot. As shown in FIG. 2, central landing 64 of armature extension 58 contacts latch arm 40 to bias latch arm 40 into contact with a transverse cross member 143 extending between legs 140 of carrier 124. In particular, armature spring 82 urges latch arm 40 against cross member 143 to maintain a predetermined angular relationship between carrier legs 140 and latch arm 40. More particularly, camming surface 142 of carrier 124 is aligned to be a predetermined distance above the camming surface 160 of latch arm 40. Pivotal movement of latch arm 40 with respect to carrier 124 is independent of the self-compensating pivotal characteristic of carrier 124 relative to support frame 100. The range of angular pivotal motion of latch arm 40 in a direction away from carrier 124 is defined by the amount of axial travel of armature 52 generated upon energization of solenoid 32. Therefore, the axial travel requirement of solenoid 32 is primarily dependent on disengaging latch arm 40 from striker 28 without regard to variations in the lateral position of the striker. This allows use of a substantially smaller and less expensive solenoid 32.

Latch arm 40 is provided with a central elongated slot 154 which terminates at its lower end with a circular bore 156 through which second enlarged end landing 66 of armature extension 58 is installed prior to mounting pivot pin 150 in apertures 152. In particular, once second landing 66 is installed through bore 156, the portion of central stem 60 intermediate landings 64 and 66 is slid upward to a position which permits pivot pin 150 to be installed in apertures 152. Therefore, latch arm 40 is coupled to armature 52 such that translational movement of armature 52 produces pivotal movement of latch arm 40 about the second pivot. Latch arm 40 camming surface 160 provided at its upper end is configured similarly to that of camming surface 142 of upstanding legs 140 and terminates in an engaging edge 162. Again, camming surface 160 is located a predetermined distance below carrier camming surface 142 to enable striker 28 to contact legs 140 prior to contacting latch arm 40. In this manner, throughout the range of pivotal motion of carrier 124, illustrated in FIG. 7, latch arm 40 is maintained in contact with cross-member 143.

In operation, when fuel filler door 22 is closed, camming surface 144 on striker 28 contacts camming surface 142 of at least one, and preferably both, upstanding legs 140 to pivotally displace carrier 124 in opposition to torsion spring 126 to compensate for alignment variations of striker 28 relative to latch arm 40. Because latch arm 40 is biased to be maintained in contact with cross-member 143 of carrier 126, the relative positioning and orientation of latch arm 40 relative to carrier 124 remains substantially uniform during pivotal displacement of carrier 124. Thereafter, striker camming surface 144 engages latch arm camming surface 160 to pivot latch arm 40 about the second pivot until striker engaging surface 164 passe latch arm engaging surface 162. At this instant, spring 82 acting on armature 52 moves latch arm 40 into engagement with striker 28. It is contemplated that torsion spring 126 may have its second end 132 secured to latch arm 40 and carrier 124 to bias latch arm 40 into maintained contact with carrier 124. Likewise, a second spring may be disposed between carrier 124 and latch arm 40 to bias latch arm 40 against cross-member 143.

To release striker 28, latch arm 40 must only be pivoted until engaging edge 166 of striker 28 is disengaged from engaging surface 162 of latch arm 40. This is accomplished through energization of solenoid 32 for attracting armature 52 toward pole piece 46. Thereafter, hinge 20 is normally biased to pivot door assembly 18 and striker 28 away from opening 16 to provide access to the fuel filler cap. Dimensional variations affecting the alignment of striker 28 relative to latch mechanism 30 are compensated for by the pivotable movement of carrier 124 prior to striker 28 contacting latch arm 40. In this manner, solenoid 24 can be relatively small in size since the armature travel required to move latch arm 40 to the released position can be substantially reduced. As previously noted, cable 84 is supplied for manually disengaging latch arm 40 from striker 28. In those situations where solenoid 24 is disabled, axial movement of cable assembly 84 will move armature 52 toward pole piece 46, thereby pivoting latch arm 40 to disengage striker 28.

Finally, it is to be noted that the fuel filler housing assembly 10 does not require manual adjustment of the "for and aft" position of striker 28 relative to camming surface 142 of latch arm 40. In particular solenoid/latch assembly 34 may be installed within fuel filler housing assembly without post assembly alignment or solenoid calibration. As such, significant improvements in system reliability and reductions in installation costs are realized.

While the above description constitutes the preferred embodiment of the present invention, it will be appreciated that the invention is susceptible to modification, variation and change without departing from the proper scope or fair meaning of the accompanying claims. In particular, it is contemplated that the self-compensating latch mechanism of the present invention may be used with any actuation means known in the art for vehicular applications requiring a door release system. Likewise, it is contemplated that the present invention may be used for any vehicular latch application which requires engagement between a striker and a latching member. In this manner, dimensional variations and "stack-up" tolerances are compensated for without the need of secondary adjustment requirements.

What is claimed is:

1. A self-compensating latch adapted to be mounted to a motor vehicle structure to engage a striker, comprising:

a support frame mounted to the vehicle structure;

a carrier having a first camming surface engagable with the striker;

first pivot means for enabling said carrier to rotate relative to said support frame about a first pivot;

a latch arm having a second camming surface engagable with the striker;

second pivot means for enabling said latch arm to rotate relative to said carrier about a second pivot; and biasing means for biasing said carrier and said latch arm about said first pivot, said biasing means further acting to bias said latch arm about said second pivot to urge said latch arm into contact with said carrier for defining a generally uniform angular relationship between said first and second camming surfaces;

said first camming surface of said carrier adapted to contact the striker such that said carrier and said latch arm rotate about said first pivot in a direction opposing said biasing means to align said latch arm in a predetermined alignment relative to the striker thereby compensating for alignment variations between the striker and said latch arm, said second camming surface of said latch arm adapted to thereafter contact the striker and rotate said latch arm about said second pivot until it lockingly engages the striker in a latched position.

2. The self-compensating latch of claim 1 wherein said latch arm is associated with actuation means for releasing said striker from engagement with said latch arm to define an unlatched position.

3. The self-compensating latch of claim 2 wherein said latch arm is fixed for rotation with respect to said carrier about said second pivot such that said actuation means enables said latch arm to rotate from said latched position to said unlatched position.

4. The self-compensating latch of claim 3 wherein said support frame is adapted to be mounted to the vehicle structure such that said carrier is fixed for rotation with respect to said support frame about said first pivot.

5. The self-compensating latch of claim 4 wherein said support frame has a wall surface and a pair of side walls extending transversely from said wall surface, said carrier and latch member being secured between said side walls for pivotal movement therebetween, and wherein said biasing means includes a first torsion spring having a first end acting on said support frame and a second end acting on said carrier.

6. The self-compensating latch of claim 5 wherein said first camming surface of said carrier is adapted to contact the striker so as to simultaneously rotate said carrier and latch arm about said first pivot in opposition to said first torsion spring, said second camming surface of said latch arm adapted to contact the striker after said carrier has been rotated about said first pivot such that said latch arm is rotated about said second pivot until the striker is secured to an engaging surface provided on said latch arm.

7. The self-compensating latch of claim 6 wherein said actuation means comprises a solenoid assembly having a movable armature adapted to translate within said solenoid assembly in response to an electrical input, said movable armature operatively coupled to said latch arm for causing said latch arm to rotate about said second pivot toward said unlatched position in response to said electrical input.

8. A self-compensating latch adapted to be mounted to a motor vehicle structure to engage a striker, comprising:

a support frame adapted to be mounted to the vehicle structure;

a carrier fixed for rotation with respect to said support frame about a first pivot, said carrier having a first camming surface engagable with the striker;

a latch arm fixed for rotation with respect to said carrier about a second pivot, said latch arm having a second camming surface engagable with the striker;

first biasing means for biasing said carrier and said latch arm about said first pivot in a direction toward a latched position; and second biasing means for biasing said latch arm about said second pivot to urge said latch arm into contact with a portion of said carrier to define a predetermined angular orientation between said first and second camming surfaces;

said first camming surface of said carrier adapted to contact the striker such that said carrier and latch arm simultaneously rotate about said first pivot in a direction opposing said first biasing means to align said latch arm in a predetermined alignment relative to said carrier for compensating for alignment variation therebetween, said second camming surface of said latch arm adapted to thereafter engage the striker to secure the striker in said latched position.

9. The self-compensating latch of claim 8 wherein said latch arm is associated with actuation means for causing said latch arm to rotate in opposition to said second biasing means to release said latch arm from engagement with the striker for thereby defining an unlatched position.

10. The self-compensating latch of claim 9 wherein said support frame includes a mounting wall portion having at least one side wall extending transversely therefrom, said carrier fixed to said side wall for pivotable motion along a plane generally parallel to said side wall.

11. The self-compensating latch of claim 10 wherein said carrier has a top and bottom end with said top end having at least one upstanding leg defining said first camming surface thereon engageable with the striker, said first biasing means comprising a torsion spring having a first end acting on said side wall and a second end acting on said upstanding leg to bias said top end of said carrier toward the striker.

12. The self-compensating latch of claim 11 wherein said latch arm has a top and bottom end with said bottom end fixed for rotation to said bottom end of said carrier, said top end of said latch arm defining said second camming surface engageable with the striker and which terminates in an engaging surface for lockingly engaging the striker thereon, said second biasing means urging said latch arm into contact with said carrier such that said second camming surface of said latch arm is located a predetermined distance below said first camming surface of said carrier.

13. The self-compensating latch of claim 12 wherein said carrier includes a tab stop member provided at a lower end thereof which is adapted to engage said support frame for limiting the range of rotational motion of said carrier.

14. A self-compensating latch adapted to be mounted to a motor vehicle structure to engage a striker, comprising:

a support frame having a rear surface adapted to be mounted to the vehicle structure and a front surface having at least one side wall extending transversely therefrom;

an elongated carrier fixed to said side wall for pivotable motion along a plane generally parallel thereto about a first pivot, said carrier having a top and bottom end with said top end having at least one upstanding leg member defining a first camming surface thereon engageable with the striker;

a latch arm fixed for rotation to said carrier about a second pivot, said latch arm having a top end defining a second camming surface;

first spring means associated with said carrier and said support frame for biasing said carrier and said latch arm about said first pivot toward a latched position;

second spring means for biasing said latch arm about said second pivot to urge said latch ar into contact with said carrier to define a predetermined angular orientation therebetween such that said second camming surface is located a predetermined distance below said first camming surface; and actuation means associated with said latch arm for rotating said latch arm about said second pivot in opposition to said second spring means to release said striker from engagement with said latch arm thereby defining an unlatched position;

said first camming surface of said carrier adapted to contact the striker such that said carrier and latch arm simultaneously rotate about said first pivot in a direction opposing said first spring means to align said latch arm relative to the striker, said second camming surface of said latch arm adapted to thereafter engage the striker such that continued engagement enables said latch arm to secure the striker in said latched position.

15. The self-compensating latch of claim 14 wherein said support frame comprises a pair of parallel side walls such that said carrier and latch member are pivotally disposed between said side walls to define said first pivot, and wherein said first spring means include a first torsion spring having a first end acting on one of said side walls and a second end acting on said carrier.

16. The self-compensating latch of claim 15 wherein said carrier is configured to define two upstanding leg members having a camming surface thereon engageable with the striker and having a transverse cross-member portion, and wherein said second spring means urges said latch arm into contact with said transverse cross-member portion of said carrier to align said first camming surface of said carrier and said second camming surface of said latch arm in generally adjacent displaced orientation.

17. A remotely actuated latch adapted to be mounted to a motor vehicle structure and engageable with a striker, comprising:

a solenoid assembly including a pole piece, an armature movable between a first position displaced from said pole piece to a second position attracted toward said pole piece, a solenoid winding creating a magnetic flux to attract said armature to said second position through energization of said winding, and spring means for urging said armature to said first position; and a self-compensating latch mechanism associated with said solenoid assembly for lockingly engaging the striker when said armature is in one of said positions and releasably disengaging the striker when said armature is in the other of said positions, said latch mechanism having alignment compensating means for varying the position of said latch mechanism relative to the striker to compensate for alignment variations between said latch mechanism and the striker, said self-compensating latch mechanism including:

a carrier;

a latch arm associated with said carrier;

first pivot means for enabling said carrier and said latch means to rotate about a first pivot;

biasing means for biasing said carrier and said latch arm about said first pivot, said biasing means adapted to normally maintain a predetermined angular relationship between said carrier and said latch arm; and coupling means for coupling said latch arm to said armature such that said latch arm is adapted to move to a latched position when said armature is in said first position and to an unlatched position when said armature is in said second position;

said carrier adapted to initially contact the striker such that said carrier and said latch arm rotate about said first pivot to position said latch arm in a predetermined alignment relative to the striker to compensate for alignment variations of the striker relative to said latch arm, said latch arm thereafter adapted to engage the striker to secure the striker in said latched position.

18. The remotely actuated latch of claim 17 wherein said latch arm is fixed to rotation with respect to said carrier about a second pivot such that said coupling means enables said latch arm to rotate from said latched position to said unlatched position, and wherein said spring means associated with said armature acts to bias said latch arm about said second pivot so as to urge said latch arm into contact with said carrier to define said predetermined angular relationship therebetween.

19. The remotely actuated latch of claim 18 wherein said carrier is adapted to pivot in a direction opposing said biasing means upon contact with the striker to position said latch arm in a predetermined alignment with respect to the striker.

20. The remotely actuated latch of claim 19 further comprising a support frame adapted to be mounted to a portion of said solenoid assembly, said carrier being fixed for rotation with respect to said support frame about said first pivot.

21. The remotely actuated latch of claim 20 wherein said support frame has a front wall portion and a pair of side walls extending transversely from said front wall portion, said carrier and said latch arm being secured between said side walls for pivotal movement therebetween, and wherein said biasing means includes a first torsion spring having a first end acting on one of said side walls and a second end acting on said carrier.

22. The remotely actuated latch of claim 21 wherein said carrier has a first camming surface adapted to contact the striker so as to simultaneously rotate said carrier and latch arm about said first pivot in opposition to said first torsion spring, said latch arm having a second camming surface adapted to contact the striker after said carrier has been rotated about said first pivot such that said latch arm is rotated about said second pivot in a direction opposing said spring means until the striker is secured to an engaging surface provided on said latch arm.

23. The remotely actuated latch of claim 22 wherein said latch arm has a top and bottom end with said bottom end fixed for rotation to said bottom end of said carrier, said spring means urging said latch arm into engagement with said carrier such that said second camming surface associated with said top end of said latch arm is located a predetermined distance below said first camming surface of said carrier, said second camming surface engageable with the striker and terminating in an engaging surface for lockingly engaging the striker thereon.

24. The remotely actuated latch of claim 17 wherein said latch mechanism is secured directly to said solenoid assembly to define a solenoid/latch assembly adapted to be at least partially disposed within a fuel filler housing having a pivotable door member on which the striker is secured.

25. A solenoid actuated latch adapted to be mounted to a motor vehicle structure and engageable with a striker, comprising:

a solenoid assembly having an energization coil assembly defining a longitudinal bore, an armature assembly disposed in said bore and adapted to translate in response to energization of said coil assembly, pole means for defining a working air gap across which magnetic fields are transferred thereby generating an attracting force between said pole means and said armature assembly which urges said armature assembly to move toward said pole means when said coil assembly is energized, and first spring means disposed between said pole means and said armature assembly urging said armature assembly away from said pole means when said coil assembly is de-energized;

a support frame adapted to be mounted to said solenoid assembly;

a carrier fixed for rotation with respect to said support frame about a first pivot;

a latch arm fixed for rotation with respect to said carrier about a second pivot;

coupling means for interconnecting said latch arm to said armature assembly such that said latch arm is pivotally movable upon movement of said armature assembly; and second spring means for biasing said carrier and latch arm about said first pivot;

said first spring means biasing said latch arm about said second pivot, said carrier adapted to contact the striker such that said carrier rotates about said first pivot in a direction opposing said second spring means to align the striker relative to said latch arm, said latch arm adapted to thereafter contact the striker to lockingly engage the striker in said latched position.

26. The solenoid actuated latch of claim 25 wherein said latch arm is coupled to said armature assembly such that said latch arm is in a latched position when said coil assembly is de-energized and in a unlatched position when said coil assembly is energized.

27. The solenoid actuated latch of claim 26 wherein said first spring means is adapted to maintain said latch arm in contact with said carrier to define a predetermined angular orientation therebetween such that simultaneous rotation of said carrier and said latch arm about said first pivot acts to align said latch arm relative to the striker to compensate for alignment variation associated with the striker.

28. The solenoid actuated latch of claim 27 wherein said support frame has a wall surface having a pair of generally parallel side walls extending transversely therefrom, said carrier and latch arm secured between said side walls for pivotable motion therebetween.

29. The solenoid actuated latch of claim 28 wherein said carrier is an elongated member having a top and bottom end with said top end having at least one upstanding leg defining a first camming surface thereon engageable with the striker, said second spring means comprising a torsion spring having a first end acting on one of said side walls and a second end acting on said upstanding leg to bias said top end of said carrier toward said latched position.

30. The solenoid actuated latch of claim 29 wherein said latch arm includes a top and bottom end with said bottom end fixed for rotation to said bottom end of said carrier, said top end of said latch arm defining a second camming surface thereon engageable with the striker and which terminates in an engaging surface for lockingly engaging the striker thereon, said first spring means urging said second camming surface into generally adjacent alignment with said first camming surface so as to be located a predetermined distance below said first camming surface of said carrier.

31. The solenoid actuated latch of claim 30 wherein said carrier includes a tab stop member provided at said bottom end thereof which is adapted to engage said support frame for limiting the range of biased rotational motion of said carrier in a direction toward said latched position.

32. A door latching apparatus adapted to be mounted to a motor vehicle structure and engageable with a striker, comprising:

a housing adapted to be mounted to the motor vehicle structure, said housing defining an inner chamber and having an access opening;

a door assembly pivotally secured to said housing for enclosing said access opening when said door assembly is moved to a closed position, the striker being secured to said door assembly for entry into said chamber of said housing;

a self-compensating latch mechanism associated with said housing and disposed within said chamber for lockingly engaging the striker when said door assembly is closed and for releasably disengaging the striker when said door assembly is open, said self-compensating latch mechanism comprising:

a support frame mounted to the vehicle structure;

a carrier;

first pivot means for enabling said carrier to rotate relative to said support frame about a first pivot;

a latch arm;

second pivot means for enabling said latch arm to rotate relative to said carrier about a second pivot; and biasing means for biasing said carrier and said latch arm about said first pivot, said biasing means adapted to maintain a predetermined angular relationship between said carrier and said latch arm with respect to said second pivot;

said carrier adapted to initially contact the striker such that said carrier and said latch arm rotate about said first pivot to align said latch arm in a predetermined alignment relative to the striker thereby compensating for alignment variations between the striker and said latch arm, said latch arm adapted to thereafter contact the striker and rotate about said second pivot until it lockingly engages the striker in a latch position; and actuation means coupled to said latch arm for selectively controlling movement of said latch arm relative to the striker bar from a latched position to an unlatched position for releasing said door assembly.

33. The door latching apparatus of claim 32 wherein said actuation means comprises a solenoid assembly including a pole piece, an armature movable between a first position displaced from said pole piece to a second position attracted toward said pole piece, a solenoid winding attracting said armature to said second position through energization of said winding, and spring means for urging said armature to said first position, and wherein said latch arm of said self-compensating latch mechanism is coupled to said armature for lockingly engaging the striker when said armature is in one of said positions and releasably disengaging the striker when said armature is in the other of said positions.

34. The door latching apparatus of claim 33 wherein said latch arm is fixed for rotation with respect to said carrier about said second pivot such that said coupling means enables said latch arm to rotate from said latched position to said unlatched position, and wherein said spring means associated with said armature acts to bias said latch arm about said second pivot so as to urge said latch arm into contact with said carrier to define a predetermined angular relationship therebetween.

35. The door latching apparatus of claim 34 wherein said carrier is adapted to pivot in a direction opposing said biasing means upon contact with the striker to position said latch arm in said predetermined alignment with respect to the striker.

36. The door latching apparatus of claim 35 wherein said support frame is adapted to be mounted to a portion of said solenoid assembly, said carrier being fixed for rotation with respect to said support frame about said first pivot.

37. The door latching apparatus of claim 36 wherein said support frame includes a front wall portion and a pair of side walls extending transversely from said front wall portion, said carrier and said latch arm being secured between said side walls for pivotal movement therebetween, and wherein said biasing means includes a first torsion spring having a first end acting on one of said side walls and a second end acting on said carrier.

38. The door latching apparatus of claim 37 wherein said carrier is an elongated member having a top end defining a first camming surface adapted to contact the striker so as to simultaneously rotate said carrier and latch arm about said first pivot in opposition to said first torsion spring, said latch arm having a top end defining a second camming surface adapted to contact the striker after said carrier has been rotated about said first pivot such that said latch arm is rotated about said second pivot in a direction opposing said spring means until the striker is secured to an engaging surface provided on said latch arm.

39. The door latching apparatus of claim 38 wherein said latch arm has a bottom end fixed for rotation to a bottom end of said carrier, and wherein said biasing means includes spring means for urging said latch arm into engagement with said carrier such that said second camming surface associated with said latch arm is located a predetermined distance below said first camming surface of said carrier.

40. A fuel filler door latch assembly adapted to be mounted to a motor vehicle structure and engageable with a striker, comprising:

a housing member defining an inner chamber and having an access opening, said housing adapted to be mounted to the motor vehicle structure;

a door assembly pivotally secured to said housing for covering said access opening when said door assembly is in a closed position, the striker secured to said door assembly so as to be disposed within said chamber of said housing when said door assembly is in said closed position;

a solenoid actuated latch assembly extending at least partially into said housing through an aperture therein, said latch assembly including a solenoid having an energization coil assembly defining a longitudinal bore, an armature assembly disposed in said bore and adapted to translate in response to energization of said coil assembly, pole means for defining a working air gap across which magnetic fields are transferred thereby generating an attracting force between said pole means and said armature assembly which urges said armature assembly to move toward said pole means when said coil assembly is energized and first spring means disposed between said pole means and said armature assembly urging said armature assembly away from said pole means when said coil assembly is de-energized;

said latch assembly including a latch mechanism including a support frame mounted to said solenoid, an elongated carrier fixed for rotation with respect to said support frame about a first pivot, and a latch arm fixed for rotation with respect to said carrier about a second axis;

coupling means for interconnecting said latch arm to said armature assembly; and second spring means for biasing said carrier and latch arm about said first pivot;

said first spring means biasing said latch arm about said second pivot, said carrier adapted to contact the striker such that said carrier rotates about said first pivot in a direction opposing said second spring means to align said latch arm relative to the striker thereby compensating for alignment variations between the striker and said latch arm, said latch arm adapted to thereafter engage the striker to secure the striker in said latch position.

41. The fuel filler door latch assembly of claim 40 wherein said latch arm is directly coupled to said armature assembly such that said latch arm is in a latched position when said coil assembly is de-energized and in a unlatched position when said coil assembly is energized.

42. The fuel filler door latch assembly of claim 41 wherein said first spring means is adapted to maintain said latch arm in contact with said carrier to define a predetermined angular orientation therebetween.

43. The fuel filler door latch assembly of claim 42 wherein said support frame has a front wall having a pair of generally parallel side walls extending transversely therefrom, said carrier and latch arm secured between said side walls for pivotable motion therebetween.

44. The fuel filler door latch assembly of claim 43 wherein said carrier is an elongated member having a top and bottom end with said top end having at least one upstanding leg defining a first camming surface thereon engageable with the striker, and wherein said second spring means comprises a torsion spring having a first end acting on one of said side walls and a second end acting on said upstanding leg to bias said top end of said carrier toward the striker.

45. The fuel filler door latch assembly of claim 44 wherein said latch arm has a top and bottom end with said bottom end fixed for rotation to said bottom end of said carrier, said top end of said latch arm defining a second camming surface thereon engageable with the striker and which terminates in an engaging surface for lockingly engaging the striker thereon, said first spring means urging said latch arm into contact with said carrier such that said second camming surface of said latch arm is located a predetermined distance below said first camming surface of said carrier.

46. The fuel filler door latch assembly of claim 45 wherein said carrier includes a tab stop member provided at a lower end thereof which is adapted to engage said support frame for limiting the range of biased rotational motion of said carrier toward said latched position.

* * * * *